US008517036B2

(12) United States Patent
Calhoun

(10) Patent No.: US 8,517,036 B2
(45) Date of Patent: Aug. 27, 2013

(54) WAREWASHING SYSTEM ARM

(75) Inventor: James S. Calhoun, Corbin, KY (US)

(73) Assignee: Jackson WWS, Inc., Barbourville, KY (US)

( * ) Notice: Subject to any disclaimer, the term of this patent is extended or adjusted under 35 U.S.C. 154(b) by 0 days.

(21) Appl. No.: 12/971,618

(22) Filed: Dec. 17, 2010

(65) Prior Publication Data

US 2011/0146735 A1 Jun. 23, 2011

Related U.S. Application Data

(60) Provisional application No. 61/287,597, filed on Dec. 17, 2009.

(51) Int. Cl.

| | |
|---|---|
| ***B08B 3/00*** | (2006.01) |
| ***B08B 3/12*** | (2006.01) |
| ***B08B 6/00*** | (2006.01) |

(52) U.S. Cl.
USPC ..... 134/199; 134/56 D; 134/57 D; 134/58 D; 134/198

(58) Field of Classification Search
USPC ..... 134/198, 199, 56 D, 57 D, 58 D
See application file for complete search history.

(56) References Cited

U.S. PATENT DOCUMENTS

| | | | | |
|---|---|---|---|---|
| 2,320,133 | A * | 5/1943 | Horwitz | 134/179 |
| 3,236,249 | A | 2/1966 | Everroad | 134/167 |
| 3,861,060 | A * | 1/1975 | McNair | 34/97 |
| 4,137,929 | A * | 2/1979 | Grossman | 134/182 |
| 5,131,419 | A | 7/1992 | Roberts | 134/50 |
| 5,651,382 | A * | 7/1997 | Sargeant et al. | 134/174 |
| 5,927,616 | A | 7/1999 | Grise et al. | 239/600 |
| 6,000,631 | A * | 12/1999 | Lamminen et al. | 239/200 |
| 6,325,083 | B1 | 12/2001 | Woerter | 134/180 |
| 6,571,812 | B1 * | 6/2003 | Lavoie et al. | 134/191 |
| 6,964,090 | B2 | 11/2005 | Mathieu et al. | 29/458 |
| 7,314,188 | B2 | 1/2008 | Watson et al. | 239/556 |
| 7,404,410 | B2 | 7/2008 | Pardini | 134/144 |
| 7,754,026 | B2 | 7/2010 | Kehl | 134/58 D |
| 2009/0120474 | A1 * | 5/2009 | Kehl | 134/58 D |
| 2009/0211605 | A1 * | 8/2009 | Ahmad | 134/18 |

OTHER PUBLICATIONS

International Search Report issued Feb. 11, 2011 in the corresponding PCT/US2010/061061.
International Preliminary Report on Patentability issued Jan. 25, 2012 in the corresponding PCT/US2010/061061.

* cited by examiner

*Primary Examiner* — Joseph L Perrin
*Assistant Examiner* — Charles W Kling
(74) *Attorney, Agent, or Firm* — Nelson Mullins Riley & Scarborough, LLP

(57) ABSTRACT

A rinse arm or wash arm includes a tubular body connected to a fluid source. The tubular body has at least a first aperture and a second aperture therethrough. The first aperture forms a first spray and the second aperture forms a second spray when the fluid flows through the tubular body from the fluid source. The first aperture has a first aperture axis therethrough and the second aperture has a second aperture axis therethrough. The first aperture axis forms a first angle with a first vertical axis and the second aperture axis forms a second angle with a second vertical axis. The first angle is greater than 0 degrees, so that the first aperture directs the first spray towards the second spray forming an overlapping spray of the first spray and the second spray.

19 Claims, 7 Drawing Sheets

WAREWASHING SYSTEM ARM

CROSS REFERENCE TO RELATED PATENT APPLICATIONS

This application claims the benefit of U.S. Provisional Application No. 61/287,597, filed Dec. 17, 2009. The contents of U.S. Provisional Application No. 61/287,597, filed Dec. 17, 2009, are hereby incorporated herein by reference in their entirety.

BACKGROUND

1. Field of the Disclosure

The present disclosure relates generally to spray of fluid in a warewashing system and methods therefore. More particularly, the present disclosure relates to an arm for spraying fluid within a warewashing system that is arched.

2. Description of Related Art

Warewashing systems have one or more arms that spray fluid, for example, water, onto wares, such as, glasses, utensils, plates, and the like. Warewashing systems may have wash arms and rinse arms. Wash arms recirculate water that includes detergent from a wash tank. Rinse arms within warewashing systems serve dual functions of removing chemical detergent left over after the wash cycle and imparting heat energy (commonly referred to as heat units) to the ware for sanitization purposes.

Arms that spray fluid are critical in warewashing systems to achieve cleanliness and sanitization, with water and detergents and/or sanitizing agents being sprayed from the arms. This spraying causes patterns of pumped wash water, pumped rinse water, pressure rinse water (collectively "water"); detergents; rinse agents and/or sanitizers or air to be dispersed across and amongst the ware being washed throughout the warewashing system. The water imparts/conveys heat to the ware in the warewashing system for sanitizing purposes. The position and number of spray nozzles along a length of an arm and the configuration of the arm itself causes patterns of spray dispersion coverage. The spray may miss some ware in part or entirely, wasting water, detergents, rinse agents and/or sanitizers or air and diminishing wash, rinse or air effectiveness.

In typical warewashing systems, the arms are linear and may be stationary or rotating. The nozzles are arranged along the length of the arm so that angles of spray dispersion are substantially perpendicular to the ware, creating cone-like dispersion patterns 8, as depicted in FIG. 1.

As shown in FIG. 1, a typical arm 10 has standard nozzles 12 distributed along a length 14 of the arm. Arm 10 has a wall 16 that forms a conduit to receive fluid, such as, for example, water. For example, arm 10 may connect to a water source 100 by a connector 18. Water source 100 generates a pressure to provide a flow of the water through wall 16 and out nozzles 12. Each nozzle 12 has a passage therethrough that is substantially perpendicular to the conduit of wall 16. Nozzles 12 yield a spray pattern as in angle A that varies depending upon nozzle size and flow pressure in arm 10. Nozzles 12 may each have a conical aperture, e.g., an opening with a diameter that increases from an end 20 of each of nozzles 12 that is connected to wall 16 to an opposite end 22 of each of nozzles 12 that is free. The conical nozzles also exhibit pattern having angle A that varies along the same parameters. Boundary B is the boundary within which a rack 24 or ware is positioned. Outside of boundary B is an area where water, detergent, rinse agents and/or sanitizers may spray beyond rack 24 or ware in conventional systems, constituting waste W beyond boundary B.

FIG. 1 is a cross section of a spray pattern 29 showing rack 24 sitting along guides 26 at a level L1 at a bottom of a warewashing system. A level L2 is a level at which ware extends above an upper edge of rack 24. A level L3 represents a maximum level at which ware may pass underneath arm 10. A cross sectional area 28 reflects areas within a spray pattern 29 where no water is sprayed. Spray pattern 29 is a spray formed by fluid passing through nozzles 12. Spray pattern 29 would not contact ware within cross sectional area 28. Areas 30-34 indicate areas of spray coverage. Area 30 indicates an area where water, detergent and/or sanitizing agent from one of nozzles 12 impact the ware in rack 24. Area 32 indicates an area where water, detergent and/or sanitizing agent from two nozzles of nozzles 12 combine to impact the ware in rack 24. Area 33 shows a spray coverage of three of nozzles 12 that combine to impact the ware in rack 24. Area 34 shows a spray coverage of four of nozzles 12 that combine that impact the ware in rack 24. Areas marked W show areas that water may miss the ware entirely, and, is wasted. As shown in FIG. 1, areas 33 that have spray coverage of three of nozzles 12 combined that impact the ware and area 34 that has four of nozzles 12 combined that impact the ware are smaller than areas 30 and 32.

Accordingly, it has been determined by the present disclosure, that there is a need for an arm of a warewashing system that has nozzles formed thereon, each forming a spray, to maximize overlap of the sprays of each of the nozzles. There is a further need for an arm that ensures that the water leaving the nozzles of the arm is not wasted by missing an intended target.

SUMMARY

A rinse arm or wash arm is provided that includes a tubular body connected to a fluid source. The tubular body has at least a first aperture and a second aperture therethrough. The first aperture forms a first spray and the second aperture forms a second spray when the fluid flows through the tubular body from the fluid source. The first aperture has a first aperture axis therethrough and the second aperture has a second aperture axis therethrough. The first aperture axis forms a first angle with a first vertical axis and the second aperture axis forms a second angle with a second vertical axis. The first angle is greater than 0 degrees, so that the first aperture directs the first spray towards the second spray forming an overlapping spray of the first spray and the second spray.

A warewashing system is also provided that includes a housing, a rack holding a plurality of wares in the housing, a rack support that supports the rack in the housing, and a tubular body connected to a fluid source. The tubular body has at least a first aperture and a second aperture therethrough. The first aperture forms a first spray and the second aperture forms a second spray when the fluid flows through the tubular body from the fluid source. The first aperture has a first aperture axis therethrough and the second aperture has a second aperture axis therethrough. The first aperture axis forms a first angle with a first vertical axis and the second aperture axis forms a second angle with a second vertical axis. The first angle is greater than 0 degrees, so that the first aperture directs the first spray towards the second spray forming an overlapping spray of the first spray and the second spray contacting the wares.

The above-described and other advantages and features of the present disclosure will be appreciated and understood by those skilled in the art from the following detailed description, drawings, and appended claims.

DETAILED DESCRIPTION OF THE PREFERRED EMBODIMENT

Figure 2:
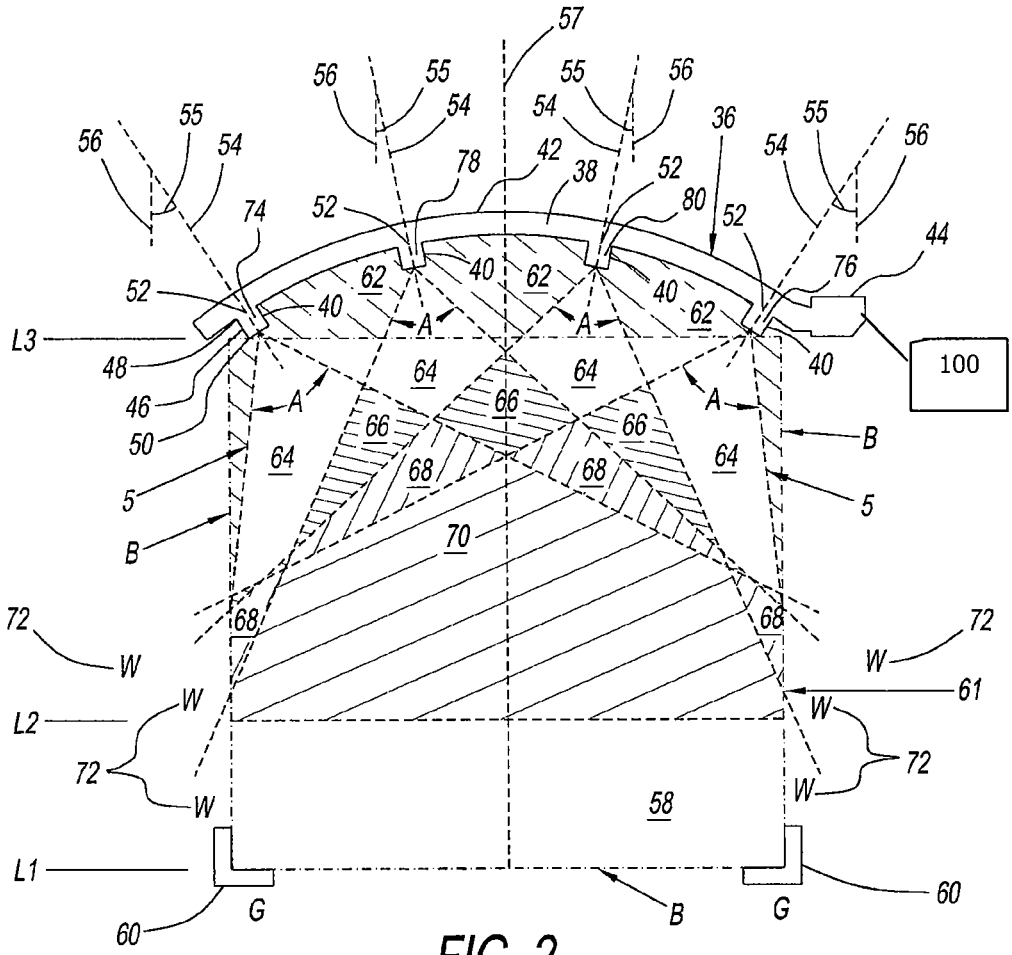
FIG. 2 is a partial side cross sectional view of an exemplary embodiment of a warewashing system having an arm according to the present disclosure.

Referring to the drawings and in particular to FIG. 2, an exemplary embodiment of an arm according to the present disclosure is generally referred to by reference numeral 36. Arm 36 can be used in any type of warewashing system for both restaurant/commercial warewashing machines and residential warewashing machines. For example, arm 36 may be a wash arm having a diameter of 1.5 inches or rinse arm having a diameter of 0.5 inch. Arm 36 has a tubular body 38 that is arched along an entire length of arm 36. Tubular body 38 has nozzles 40 distributed along the length of arm 36. Tubular body 38 has a wall 42 that forms a conduit to receive fluid, such as, for example, water and/or detergent. For example, arm 36 may connect to a water source 100 by a connector 44. Water source 100 generates a pressure to provide a flow of the water through the conduit formed by wall 42 and out of nozzles 40. The fluid passing through arm 36 out nozzles 40 has a pressure of 15 pounds per square inch gauge (psig) to 30 psig.

Figure 10:
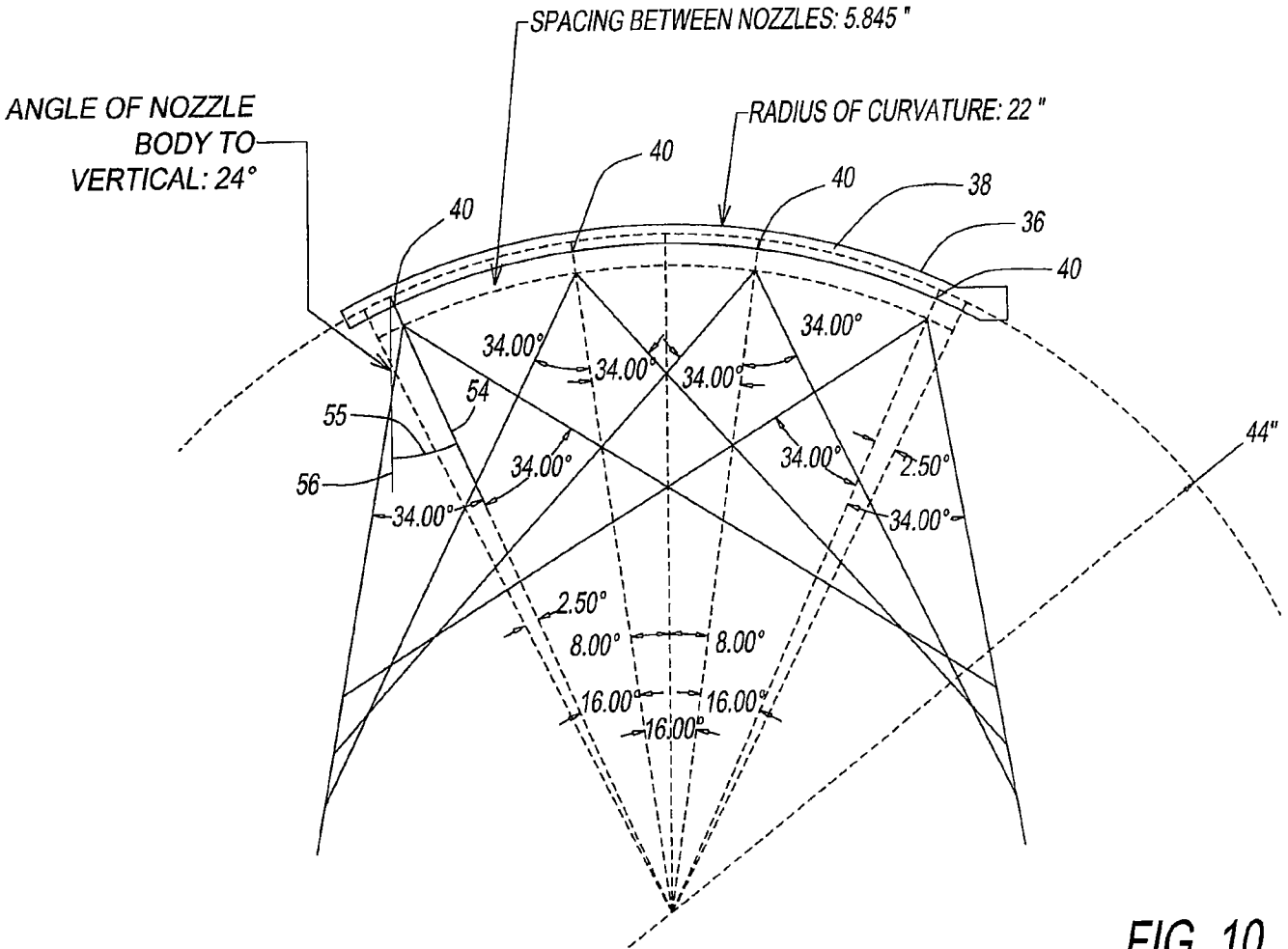
FIG. 10 is a side view of an exemplary embodiment of an arm according to the present disclosure.

Nozzles 40 may each have a nozzle wall 46. Nozzle wall 46 is connected on an end 48 to wall 42 and has an opposite end 50 that is free. Nozzle wall 46 surrounds a passage from an aperture through wall 42 to end 50 that forms a conduit. Each nozzle wall 46 may be substantially perpendicular to wall 42. Alternatively, nozzles 40 may each be formed by a bore through wall 42 and omit nozzle wall 46. The arch or curve of tubular body 38 at a point 52 where each of nozzles 40 is formed determines an angle of a spray of each of nozzles 40. Each of nozzles 40 has a nozzle axis 54 therethrough that forms an angle 55 with a vertical axis 56. At least one of nozzles 40 has angle 55 that is greater than 0 degrees, so that the at least one of nozzles 40 directs the spray towards a spray of another of nozzles 40 to overlap. Arm 36 has at least two of nozzles 40 so that the at least two of nozzles 40 each form a spray that is angled to overlap one another. Nozzles 40 are each angled toward an axis 57 that passes through an apex of the arch of tubular body 38. Nozzles 40 may be variously shaped, for example, nozzles can be conical, flat, fan-shaped. Typically, industry-standard nozzles are designed to pass certain amounts of water without clogging the nozzle. Nozzles 40 may be formed to balance an amount of water used with a size of a wash chamber of the warewashing system, and to meet an overall design and performance criteria of the warewashing system. For example, as shown in FIG. 10, angle 55 may be about 24 degrees.

Nozzles 40 may be welded perpendicularly to tubular body 38 while tubular body 38 is uncurved for ease of manufacture. Tubular body 38 is deformed or curved in a manufacturing process to form an arched shape or curve of arm 36. By being arched, an effect of angle 55 of nozzles 40 is achieved due to the curvature of the arm itself. Spacing of nozzles 40 are configured and dimensioned to meet the purpose of the warewashing system (e.g. the type of ware being processed, such as glasses, dishes, pots, and/or pans). Depending on the number of nozzles used with arm 36, the nozzles can be evenly or unevenly spaced along the arm between the placement of a nozzle at or near the ends of the arm. For example, as shown in FIG. 10, each of nozzles 40 may be about 5.8 inches from another adjacent nozzle of nozzles 40.

Tubular body 38 has a curvature that is dimensioned and configured to fit within a warewasher chamber of the warewashing system to maximize a spray pattern coverage of ware washed therein. It is desirable to maximize overlap of all of the sprays of nozzles 40. The curvature of tubular body 38 depends on the height and width of the washing chamber. For example, as shown in FIG. 10, tubular body 38 may have a radius of curvature that is about 22 inches.

As shown in FIG. 2, boundary B is the boundary within which a rack 58 that holds wares is positioned. Outside of boundary B is an area where water, detergent, rinse agents and/or sanitizers may spray beyond rack 58 or ware in conventional systems, constituting waste 72 beyond boundary B.

FIG. 2 is a cross section of a spray pattern 61 generated by arm 36 showing rack 58 sitting along guides 60 at a level L1 at a bottom of a warewashing system. Spray pattern 61 is a spray formed by fluid passing through nozzles 12. Rack 58 stores wares in the warewashing system. For example, rack 58 is an industry standard dimension, with a width of 19.5 inches (known in the industry as the 20 inch rack). Guides 60 support and position rack 58 within the warewashing system. For example, if the warewashing system is a conveyorized system, guides 60 direct movement of rack 58. Guides 60 may be guide rails that should be greater than a size of rack 58, and small enough to capture the rack and sufficient enough to hold the rack in place so that it does not fall off the guide rail. A level L2 is a level at which the ware extends above an upper edge of rack 58. For example, L2 may be about 4 inches above L1. A level L3 represents a maximum level at which ware may pass underneath arm 10. L3 can be any chamber height, depending on the purpose for which the system is designed. For example, for a warewashing system that processes both glasses and dishes and pots and pans, the industry standard heights ranges from about 18 inches to about 25 inches, and for systems that process only glasses, L3 may be lower.

Spray pattern 61 has a cross sectional area 62 within the spray pattern where no water is sprayed. Spray pattern 61 does not contact ware within cross sectional area 62. Areas 64-70 indicate areas of spray coverage. Area 64 indicates an area where water, detergent and/or sanitizing agent from one of nozzles 40 impact the ware in rack 58. Area 66 indicates an area where water, detergent and/or sanitizing agent from two nozzles of nozzles 40 combine to impact the ware. Area 68 shows a spray coverage of three of nozzles 40 combined that impact the ware. Area 70 shows a spray coverage of four of nozzles 40 combined that impact the ware. Areas marked 72 show areas that water may miss the ware entirely, and, is wasted.

The arch of tubular body 38 creates spray pattern 61 which maximizes an overall spray pattern within boundary B and increases an overall breadth of coverage of density of water, detergents, rinse agents and/or sanitizers or air in all areas of the spray pattern. Nozzles 74 and 76 at the ends of arm 36 are angled inward or toward one another, and moved to an outer edge of boundary B, as compared to nozzles 13 and 15 in FIG. 1, such that the outer edge of spray pattern 61 has no waste water that misses ware. Inner nozzles 78 and 80 are similarly angled to achieve the same result of maximizing spray dispersion and ware impact/coverage while minimizing wasted water, detergent and/or sanitizing agent.

The resultant coverage or dispersion patterns of the combined nozzles of spray pattern 61 results in larger amounts of water, detergents, rinse agents and/or sanitizers or air in all areas 64, 66, 68, 70 and 72 that actually contact the wares being washed, reduces water and reduces areas where no water may be present as ware passes. As depicted, the waste area 72 is minimized by the arm having the arch shape. With the arm having the arch shape of the present disclosure, the angles of spray dispersion are enlarged, maximizing the spray coverage, improving cleanliness and/or sanitization, and saving the amount of detergents, rinse agents and/or sanitizers or air used to achieve maximum coverage of the wares being washed.

Figure 1:
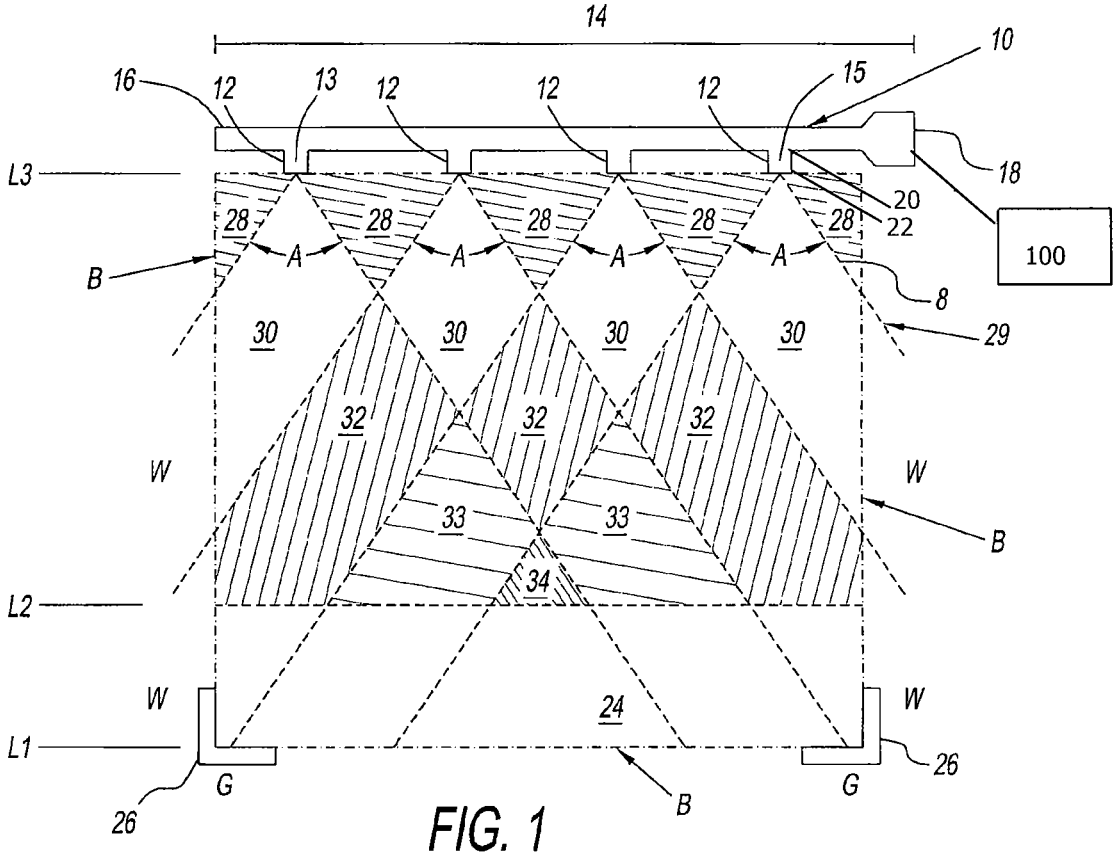
FIG. 1 (PRIOR ART)
FIG. 1 is a partial side cross sectional view of an exemplary embodiment of a warewashing system having an arm according to the prior art.

For example, in comparison to arm 10 shown in FIG. 1, cross sectional area 62 of FIG. 2 are approximately 60% smaller in size than cross sectional area 28. Areas 64 are moved upward and outward relative to areas 30, increasing coverage of area 64 at a center of spray pattern 61. Areas 66 are in areas 30 in FIG. 1. Area 70 has a size that is increased from a size of areas 34 in excess of 500 percent to 1000 percent depending on a height and an angle and number of nozzles 40 along spray pattern 61.

To compare the efficacy of arm 10 and arm 36, a comparative test that utilized a typical straight arm, arm 10, and an arched arm, arm 36, each as rinse arms to spray ware clean of soap residue as ware passes from a wash area of a warewashing system, was conducted. Test conditions and process were used that include: ware was passed through the warewashing system at a rate of 225 racks per hour; 24 juice glasses were set into each rack; a rinse spray flow rate was set at 90 gallons per hour; and a soap concentration in a wash tank was set at 15 drops as determined by titration of a detergent solution using a phenolphthalein indicator and hydrochloric acid drops to neutralize the soap/detergent. The test process included: as the rack exited the warewashing system, 1 drop of phenolphthalein indicator was placed on the top of the glasses; absence of color indicated no detergent residue is left after passing through a rinse area; and color (ranging from pink to purple) indicated detergent residue remaining. The test results included, using arm 10 as a rinse arm, 10 of the 24 glasses failed the detergent carryover for a 58% pass rate, and using arm 36 as a rinse arm, all glasses passed for a 100% pass rate.

Figure 3:
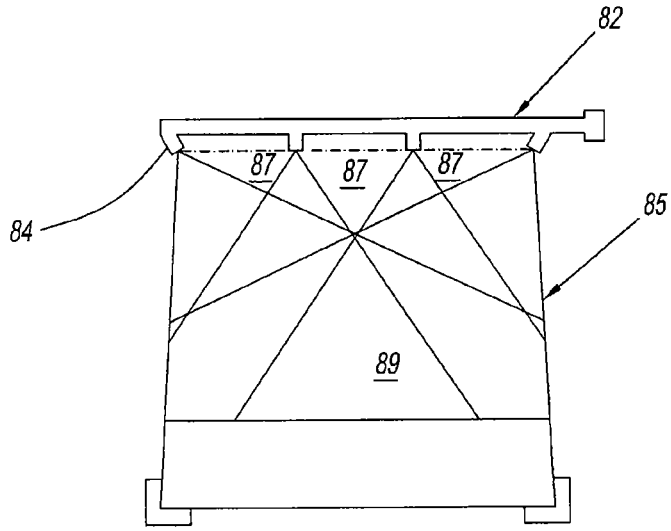
FIG. 3 is a side view of an exemplary embodiment of an arm according to the present disclosure.

Referring to FIG. 3, alternatively, an arm 82 that is uncurved or straight may have nozzles 84 installed at an angle. This is not the conventional way of manufacture and assembly for an arm of a warewashing system. Some of the effect of arm 36 may be achieved in arm 82, by a manufacturing process that allows for installation of nozzles 84 at an angle. Spray pattern 85 has a cross sectional area 87 within the spray pattern where no water is sprayed. Spray pattern 85 does not contact ware within cross sectional area 87. Area 89 shows a spray coverage of four of nozzles 40 combined that impact the ware.

Figure 4:
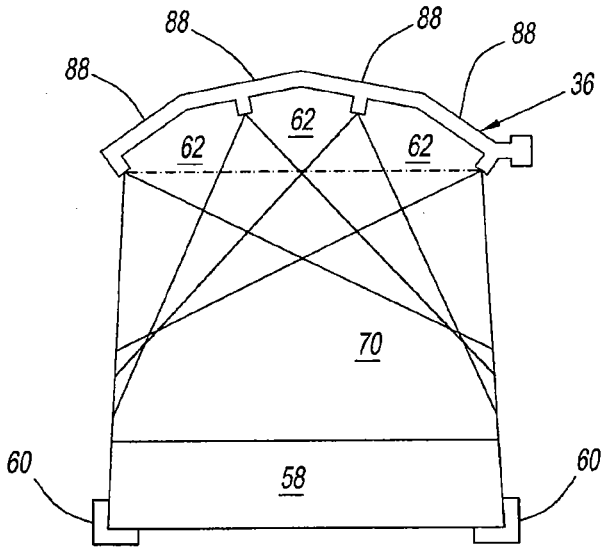
FIG. 4 is a side view of an exemplary embodiment of an arm according to the present disclosure.
Figure 5:
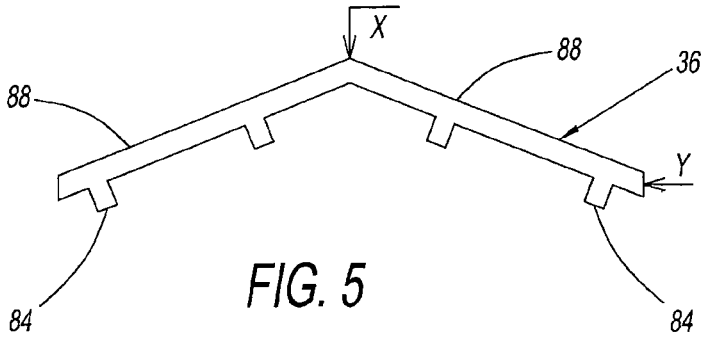
FIG. 5 is a side view of an exemplary embodiment of an arm according to the present disclosure.
Figure 6:
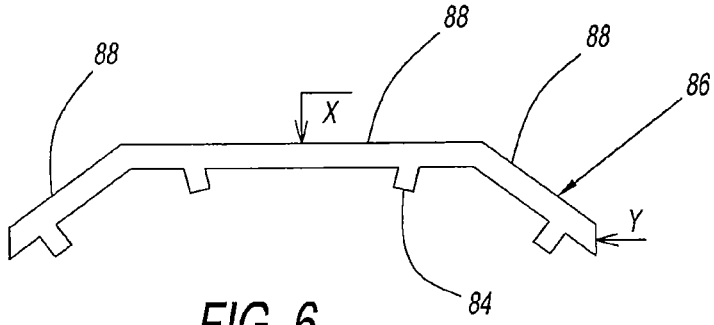
FIG. 6 is a side view of an exemplary embodiment of an arm according to the present disclosure.
Figure 7:
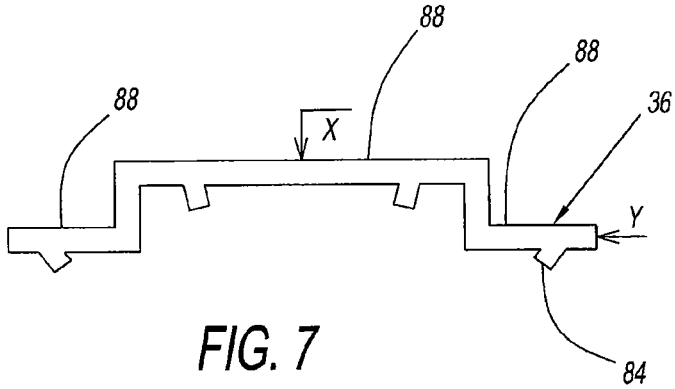
FIG. 7 is a side view of an exemplary embodiment of an arm according to the present disclosure.

Referring to FIGS. 4-6 arm 36 may be modified to include angled/segmented arches/lengths 88 (e.g., hexagonally shaped arch or other rectilinear configuration that enables nozzles to be inserted/welded into the arm to achieve an angled crossing spray patterns) to form the arch shape. As shown in FIGS. 5-7, arm 36 may be modified to include angled/segmented arches/lengths 88 and nozzles 84 installed at an angle. As shown in FIGS. 5-7, water may enter arm 36 at an opening X, for example, if arm 36 is rotatable about an axis passing through opening X, or water may enter arm 36 through opening Y, for example, if arm 36 is stationary.

Arm 36 improves the efficiency and efficacy of the warewashing system and realizes savings in water consumption and energy used over arm 10. Prior to current government regulations, such as, the Energy Star program, there was no regulation that pushed/required savings in water and other consumables (detergents, etc.) or energy consumption. Accordingly, there was no prior need to be concerned with, for example, water consumption. With the advent of new requirements, improvements to the conventional system do not sufficiently/adequately address rising requirements. The arms having the arched shape goes beyond current standards and will establish industry leadership. An example of results: the conventional systems use about 0.8 gallons of water per rack while the arms having the arched shape used as spray arms use only 0.38 gallons of water per rack. A warewashing system having the arms with an arch shape can have a water consumption of 70 gallons per hour in contrast to 300 gallons per hour of arms that are straight. The arms having an arch shape will use overall less water than conventional systems while at the same time having more of the water that is used actually cover/disperse upon the ware being washed, rinsed or sanitized. The arms having an arch shape increases a density of water that contacts the wares. Another potential savings is the use of smaller horse power pumps with the arms having the arch shape, which could save pump costs and will also save energy. The arms having the arch shape uses less rinse agents and less sanitizers and achieves better results. While conventionally systems typically use four (4) nozzles per arm, because of the efficiency and effectiveness of the arm having an arch shape, fewer nozzles per arm may be used, saving nozzle and manufacturing costs as well as water, detergent, rinse agent and sanitizers.

The arm having the arch shape can be stationary or rotatable.

Nozzles 40 are directed inwardly towards the center of the chamber to maximize the crossed spray areas in arm 36. Other alternatives could be the inward directionality but off-centered focus.

Figure 8:
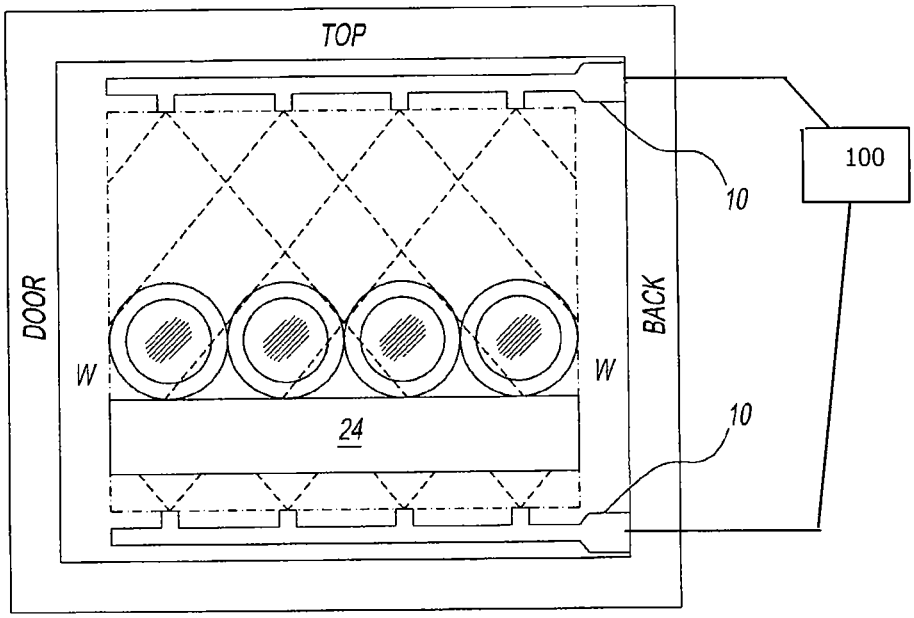
FIG. 8 (PRIOR ART)
FIG. 8 is a partial side cross sectional view of an exemplary embodiment of a warewashing system having arms according to the prior art on opposite sides of a rack.
Figure 9:
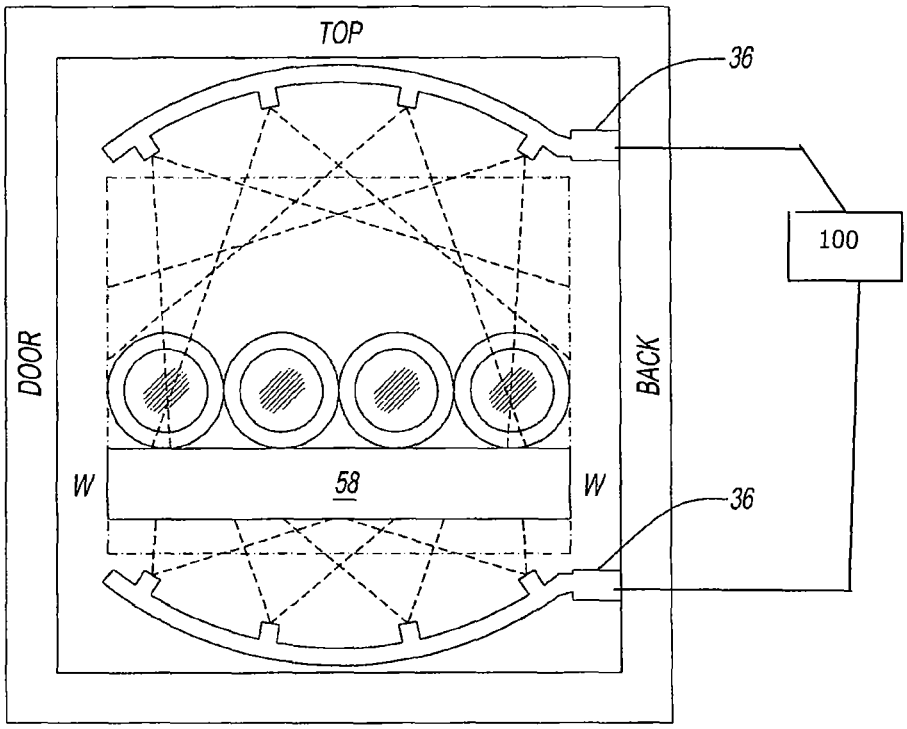
FIG. 9 is a partial side cross sectional view of an exemplary embodiment of a warewashing system having arms according to the present disclosure on opposite sides of a rack.

Referring to FIGS. 8 and 9, arm 36 can be used/implemented as an upper arm and/or lower arm, as shown in FIG. 9, that increases an amount of water contacting the wares over arm 10 having the straight shape, as shown in FIG. 8. As shown in FIG. 8, spray from nozzles 12 of arm 10 below rack 24 may not overlap prior to contact with rack 24. As shown in FIG. 9, waste area 72 is smaller under rack 58 than waste area W under rack 24 of FIG. 8.

It should also be noted that the terms "first", "second", "third", "upper", "lower", "above", "below", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A rinse arm comprising:

a tubular body having a length and being connected to a fluid source, said tubular body having at least a first aperture, a second aperture, and a third aperture therethrough, said first aperture forming a first spray, said second aperture forming a second spray, and said third aperture forming a third spray when said fluid flows through said tubular body from said fluid source, said first aperture having a first aperture axis therethrough, said second aperture having a second aperture axis therethrough, and said third aperture having a third aperture axis therethrough, said first aperture axis forming a first angle with a first vertical axis, said second aperture axis forming a second angle with a second vertical axis, and said third aperture axis forming a third angle with a third vertical axis, and at least said first angle and said third angle being greater than 0 degrees, so that said first aperture and said third aperture direct said first spray and said third spray toward said second spray forming an overlapping spray of at least said first spray, said second spray, and said third spray, said first aperture, said second aperture, and said third aperture being positioned along said length of said tubular body so that said overlapping spray can extend across an entirety of a width of a rack holding a plurality of wares.

2. The rinse arm of claim 1, wherein said tubular body is an arched shape along a length of said tubular body.

3. The rinse arm of claim 2, wherein said tubular body is curved to form said arched shape.

4. The rinse arm of claim 2, wherein said tubular body is a plurality of segments that are connected to form said arched shape, and wherein each of said plurality of segments is straight.

5. The rinse arm of claim 1, wherein said tubular body is straight along said length of said tubular body, wherein each of said first aperture and said second aperture has a nozzle wall, and wherein at least one of said nozzle walls is connected to said tubular body so that it is non-perpendicular to said tubular body.

6. The rinse arm of claim 1, further comprising a warewashing system connected to the rinse arm, and wherein said warewashing system connected to the rinse arm has a water consumption of 70 gallons per hour.

7. The rinse arm of claim 1, wherein said first aperture and said third aperture are on opposite sides of said second aperture.

8. The rinse arm of claim 1, further comprising a warewashing system connected to the rinse arm, and wherein said warewashing system connected to the rinse arm uses 0.38 gallons of water per rack.

9. A wash arm comprising:

a tubular body having a length and being connected to a fluid source, said tubular body having at least a first aperture, a second aperture, and a third aperture therethrough, said first aperture forming a first spray, said second aperture forming a second spray, and said third aperture forming a third spray when said fluid flows through said tubular body from said fluid source, said first aperture having a first aperture axis therethrough, said second aperture having a second aperture axis therethrough, and said third aperture having a third aperture axis therethrough, said first aperture axis forming a first angle with a first vertical axis, said second aperture axis forming a second angle with a second vertical axis, and said third aperture axis forming a third angle with a third vertical axis, and at least said first angle and said third angle being greater than 0 degrees, so that said first aperture and said third aperture direct said first spray and said third spray toward said second spray forming an overlapping spray of at least said first spray, an said second spray, and said third spray, said first aperture, said second aperture, and said third aperture being positioned along said length of said tubular body so that said overlapping spray can extend across an entirety of a width of a rack holding a plurality of wares.

10. The wash arm of claim 9, wherein said tubular body is an arched shape along a length of said tubular body.

11. The wash arm of claim 10, wherein said tubular body is curved to form said arched shape.

12. The wash arm of claim 10, wherein said tubular body is a plurality of segments that are connected to form said arched shape, and wherein each of said plurality of segments is straight.

13. The wash arm of claim 9, wherein said tubular body is straight along said length of said tubular body, wherein each of said apertures has a nozzle wall, and wherein at least one of said nozzle walls is connected to said tubular body so that it is non-perpendicular to said tubular body.

14. The wash arm of claim 9, wherein said first aperture and said third aperture are on opposite sides of said second aperture.

15. A warewashing system comprising:

a housing;

a rack holding a plurality of wares in said housing;

a rack support that supports said rack in said housing, said rack having a width; and a tubular body connected to a fluid source, said tubular body having at least a first aperture, a second aperture, and a third aperture therethrough, said first aperture forming a first spray, said second aperture forming a second spray, and said third aperture forming a third spray when said fluid flows through said tubular body from said fluid source, said first aperture having a first aperture axis therethrough, and said second aperture having a second aperture axis therethrough, and said third aperture having a third aperture axis therethrough, said first aperture axis forming a first angle with a first vertical axis, said second aperture axis forming a second angle with a second vertical axis, and said third aperture axis forming a third angle with a third vertical axis, and at least said first angle and said third angle being greater than 0 degrees, so that said first aperture and said third aperture directs direct said first spray and said third spray toward said second spray forming an overlapping spray of at least said first spray, said second spray, and said third spray contacting said wares, said overlapping spray extending across an entirety of said width of said rack.

16. The warewashing system of claim 15, wherein the warewashing system is a conveyorized warewashing system, and wherein said rack support is a conveyor.

17. The warewashing system of claim 15, wherein said tubular body rotates.

18. The warewashing system of claim 15, wherein said fluid passing through said tubular body out said apertures has a pressure of 15 pounds per square inch gauge (psig) to 30 psig.

19. The warewashing system of claim 15, wherein said first aperture and said third aperture are on opposite sides of said second aperture.

* * * * *

UNITED STATES PATENT AND TRADEMARK OFFICE

CERTIFICATE OF CORRECTION

PATENT NO. : 8,517,036 B2
APPLICATION NO. : 12/971618
DATED : August 27, 2013
INVENTOR(S) : James S. Calhoun It is certified that error appears in the above-identified patent and that said Letters Patent is hereby corrected as shown below:

In the Claims

Column 8, line 16, (claim 9, line 20) change “an said” to -- said --

Column 8, line 50, (claim 15, line 13) change “therethrough, and said” to -- therethrough, said --

Column 8, line 59, (claim 15, line 22) change “aperture directs direct” to -- aperture direct --

Signed and Sealed this
Twenty-second Day of April, 2014

Michelle K. Lee

Michelle K. Lee
*Deputy Director of the United States Patent and Trademark Office*